US006183345B1

(12) United States Patent
Kamono et al.

(10) Patent No.: US 6,183,345 B1
(45) **Date of Patent: *Feb. 6, 2001**

(54) POLISHING APPARATUS AND METHOD

(75) Inventors: Takashi Kamono, Utsunomiya; Matsuomi Nishimura, Omiya; Kazuo Takahashi, Kawasaki; Osamu Ikeda, Yokohama; Satoshi Ohta, Tokyo, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 09/045,651

(22) Filed: Mar. 20, 1998

(30) Foreign Application Priority Data

Mar. 24, 1997 (JP) ..... 9-069834
Mar. 18, 1998 (JP) ..... 10-068586

(51) Int. Cl.[7] ..... B24B 29/00

(52) U.S. Cl. ..... 451/8; 451/5; 451/6; 451/57; 451/287; 451/288

(58) Field of Search ..... 451/5, 6, 8, 41, 451/63, 57, 287, 288

(56) References Cited

U.S. PATENT DOCUMENTS 4,600,469 * 7/1986 Fusco et al. ..... 156/636
4,680,893 * 7/1987 Cronkhite et al. ..... 51/5 R
5,452,953 * 9/1995 Ledger ..... 356/382
5,475,889 * 12/1995 Thrasher et al. ..... 15/88.3
5,498,199 * 3/1996 Karlsrud et al. ..... 451/289
5,542,874 * 8/1996 Chikaki ..... 451/158
5,624,300 * 4/1997 Kishii et al. ..... 451/36
5,658,183 * 8/1997 Sandhu et al. ..... 451/5
5,695,384 * 12/1997 Beratan ..... 451/28
5,700,180 * 12/1997 Sandhu et al. ..... 451/5
5,733,176 * 3/1998 Robinson et al. ..... 451/41
5,777,739 * 7/1998 Sandhu et al. ..... 356/357
5,838,447 * 11/1998 Hiyama et al. ..... 356/381
5,842,909 * 12/1998 Sandhu et al. ..... 451/7

FOREIGN PATENT DOCUMENTS 9-069834 3/1997 (JP) .
10-068586 3/1998 (JP) .

* cited by examiner

*Primary Examiner*—Lowell A. Larson
*Assistant Examiner*—William Hong
(74) *Attorney, Agent, or Firm*—Fitzpatrick, Cella, Harper & Scinto

(57) ABSTRACT

In order to efficiently polish a large-area member to be polished to a desired shape, a polishing apparatus includes a first polishing station including a first holding unit for holding a member to be polished in a state in which a surface to be polished thereof is upwardly placed, and a first polishing head for holding and rotating a polishing pad whose polishing surface is larger than the surface to be polished in a state of contacting the surface to be polished, a detection station for detecting a polished state of the surface to be polished in a state in which the surface to be polished is upwardly placed, and a second polishing station including a second holding unit for holding the member to be polished in a state in which the surface to be polished thereof is upwardly placed, and a second polishing head for holding and rotating a polishing pad whose polishing surface is smaller than the surface to be polished in a state of contacting the surface to be polished.

58 Claims, 8 Drawing Sheets

POLISHING APPARATUS AND METHOD

BACKGROUND OF THE INVENTION

1. Field of the Invention

The present invention relates to a precision polishing apparatus and method for very precisely polishing a substrate, such as a semiconductor wafer or the like.

2. Description of the Related Art

Recently, as semiconductor devices tend to have ultrafine patterns and multilayer interconnections, precision polishing apparatuses for very precisely flattening the surfaces of semiconductor wafers of Si, GaAs, InP, SOI (silicon on insulator) or the like, are being demanded. Particularly, chemical mechanical polishing (CMP) apparatuses are known as precision polishing apparatuses for very precisely flattening the surfaces of substrates, such as wafers on which semiconductor devices are formed.

Conventional CMP apparatuses can be classified into two types as shown in FIGS. 7 and 8.

(1) FIG. 7 is a schematic diagram illustrating an external appearance of a polishing processing unit of a CMP apparatus for performing polishing processing in a state in which the surface to be polished of a wafer 100 is downwardly placed.

As shown in FIG. 7, the wafer 100 is held in a state in which its surface to be polished is downwardly placed, and is polished by being pressed against a polishing pad 1011 having a diameter larger than the diameter of the wafer 100 while being rotated. While the wafer 100 is polished, an abrasive (slurry) is dripped onto the upper surface of the polishing pad 1011.

In this type of apparatus, the wafer 100 is held by a wafer chuck 1003, for example, by means of vacuum suction, bonding using wax, a solution or pure water. In order to prevent displacement of the wafer 100, a guide ring 1004 is, in some cases, provided along the outer circumference of the wafer 100. The diameter of the polishing pad 1011 on a table 1001 is 3–5 times the diameter of the wafer 100. A suspension obtained by dispersing fine particles of silicon oxide in an aqueous solution of potassium hydroxide is used as the slurry.

(2) A method has also been proposed in which, as shown in FIG. 8, a wafer 100 is held on a wafer chuck 1103 having a guide ring 1104 and disposed on a wafer table 1101, in a state in which the surface to be polished of the wafer 100 is upwardly placed, and the wafer 100 is polished using a polishing pad 1111 having a diameter smaller than the diameter of the wafer 100.

These polishing apparatuses and methods can polish substrates, such as currently-used 8-inch semiconductor wafers or the like. Recently, however, as semiconductor integrated circuits tend to have fine patterns and adopt wafers having larger diameters, the diameters of wafers are expected to shift from 8 inches to 12 inches.

In order to polish large-diameter wafers, the conventional techniques have the following problems to be solved.

That is, in the apparatus shown in FIG. 7, the size of the polishing apparatus increases as the diameter of the wafer increases.

In the apparatus shown in FIG. 8, much time is required for uniformly polishing the entire surface of the wafer.

In the above-described conventional apparatuses, it is attempted to control the polishing property by optimizing the thickness, elasticity and the like of the polishing pad in order to polish an 8-inch wafer. In this case, however, it is difficult to assure fine adjustment and uniformity of the material of the polishing pad, and therefore, to very precisely polish a wafer having a larger diameter, such as 12 inches.

In particular, the polishing property of the polishing pad is degraded in the course of time. For example, while the life of the polishing pad is as long as hundreds of hours, the polishing property is degraded by tens of % within this time period.

In addition, flexibility is lacking of polishing a plurality of kinds of IC's (integrated circuits) having different chip sizes and different thicknesses and widths of interconnections with a high throughput.

SUMMARY OF THE INVENTION

It is an object of the present invention to provide a polishing apparatus and method having flexibility which can efficiently polish a large-area member to be polised to a desired shape.

According to one aspect, the present invention which achieves the above-described object relates to a polishing apparatus including a first polishing station which includes first holding means for holding a member to be polished in a state in which a surface to be polished thereof is upwardly placed, and a first polishing head for holding and rotating a polishing pad whose polishing surface is larger than the surface to be polished in a state of contacting the surface to be polished, a detection station for detecting a polished state of the surface to be polished in a state in which the surface to be polished is upwardly placed, and a second polishing station which includes second holding means for holding the member to be polished in a state in which the surface to be polished thereof is upwardly placed, and a second polishing head for holding and rotating a polishing pad whose polishing surface is smaller the the surface to be polished in a state of contacting the surface to be polished.

In one embodiment, the first polishing station, the detection station and the second polishing station are separated by partition means.

In another embodiment, the first polishing station is divided into a primary polishing station for performing polishing at a predetermined polishing speed, and a secondary polishing station for performing polishing at a speed lower than the polishing speed of the primary polishing station.

In still another embodiment, the apparatus further includes member-to-be-polished conveying means for conveying the member to be polished between the first polishing station, the detection station and the second polishing station in a state in which the surface to be polished of the member to be polished is upwardly placed.

In yet another embodiment, the first polishing station, the detection station and the second polishing station are provided within corresponding chambers separated by partition means and separated from atmospheric air.

In yet a further embodiment, the diameter of the polishing pad mounted on the first polishing head is smaller than twice the diameter of the surface to be polished.

According to another aspect, the present invention which achieves the above-described object relates to a polishing method including a first polishing step of mounting a member to be polished on first holding means in a state in which a surface to be polished of the member is upwardly placed, and polishing the surface to be polished by rotating a polishing pad whose polishing surface is larger than the surface to be polished in a state of contacting the surface to be polished, a detection step of detecting a polished state of the surface to be polished in a state in which the surface to be polished is upwardly placed, and a second polishing step of mounting the member to be polished on second holding means in a state in which the surface to be polished of the member is upwardly placed, and polishing the surface to be polished by rotating a polishing pad whose polishing surface is smaller than the surface to be polished in a state of contacting the surface to be polished.

In one embodiment, the first polishing step, the detection step and the second polishing step are separated by partition means.

In another embodiment, the first polishing step is divided into a primary polishing step of performing polishing at a predetermined polishing speed, and a secondary polishing step of performing polishing at a speed lower than the polishing speed of the primary polishing step.

In still another embodiment, the method further includes a conveying step of conveying the member to be polished between the first polishing step, the detection step and the second polishing step in a state in which the surface to be polished of the member to be polished is upwardly placed.

In yet another embodiment, the first polishing step, the detection step and the second polishing step are provided within corresponding chambers separated by partition means and separated from atmospheric air.

In yet a further embodiment, in the first polishing step, polishing is performed using a polishing pad whose diameter is smaller than twice the diameter of the surface to be polished.

In the polishing apparatus according to the first aspect, in still another embodiment, the member to be polished is a semiconductor wafer.

In still another embodiment, each of the first and second holding means is rotated around the center of the surface to be polished of the member to be polished by driving means.

In still another embodiment, each of the first and second holding means is swung along the surface to be polished of the member to be polished by driving means.

In still another embodiment, each of the first and second polishing heads includes pressing means, and driving means for rotating the polishing pad around its axis.

In still another embodiment, each of the first and second polishing heads includes driving means for swinging the polishing head along the surface to be polished of the member to be polished.

In still another embodiment, the first polishing station includes a rough polishing head where a rough polishing pad for performing rough polishing of the surface to be polished of the member to be polished is mounted, and a finishing polishing head where a finishing polishing pad for performing finishing polishing of the surface to be polished of the member to be polished is mounted.

In still another embodiment, each of the first and second polishing heads includes a small hole for supplying an abrasive or a cleaning liquid.

In still another embodiment, the apparatus further includes foreign-matter removing means for removing foreign matter adhering to the member to be polished.

In still another embodiment, the foreign-matter removing means includes a scrubbing cleaning unit, and a cleaning supply nozzle for supplying a cleaning liquid.

In still another embodiment, the scrubbing cleaning unit includes a cylindrical brush.

In the polishing method according to the second aspect, in still another embodiment, the member to be polished is a semiconductor wafer.

In still another embodiment, the member to be polished is a wafer having semiconductor devices formed thereon.

In still another embodiment, the method further includes the step of detecting a polished state of the member to be polished after completing the first and second polishing steps, and a result of the detection is subjected to feedback to at least one of the first polishing step and the second polishing step.

According to the present invention, it is possible to obtain a desired polishing speed and to very precisely polish the entire surface to be polished without greatly increasing the size of the polishing head.

Since the member to be polished can be conveyed between the respective stations without inverting the surface of the member to be polished, the throughput of polishing can be increased.

Since the polished state is detected and can be corrected using the small-diameter pad if necessary after performing polishing by the first polishing station, it is possible to very precisely polish the surface to be polished of any wafer for manufacturing IC's.

DETAILED DESCRIPTION OF THE PREFERRED EMBODIMENTS

Figure 1:
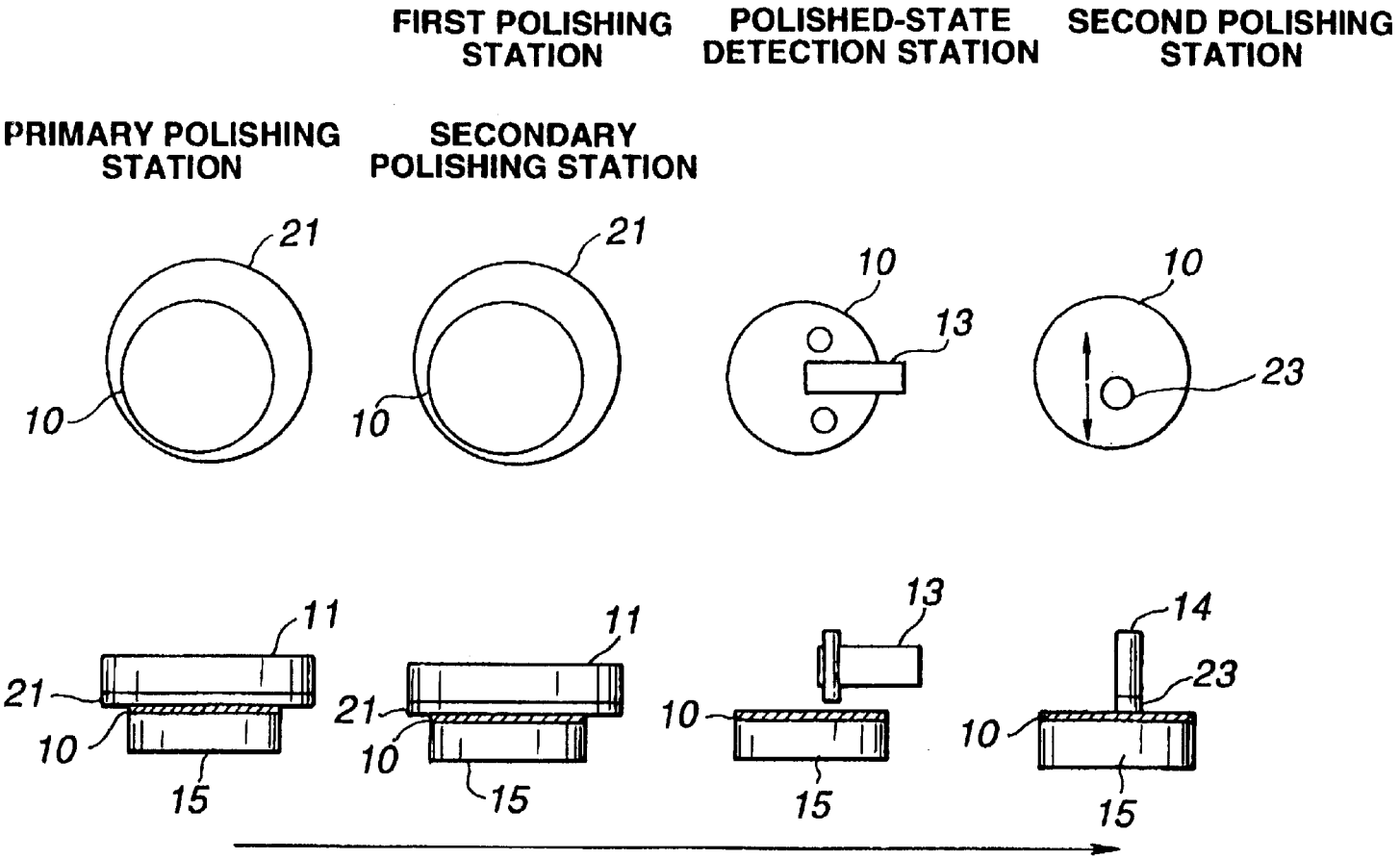
FIG. 1 is a schematic diagram illustrating a chemical mechanical polishing apparatus and method according to the present invention.

FIG. 1 is a schematic diagram illustrating a polishing apparatus and method according to the present invention.

The apparatus shown in FIG. 1 includes a first polishing station, a second polishing station, and a detection station for detecting a polished state. The first polishing station includes a primary polishing station and a secondary polishing station. In the primary polishing station, the entire surface to be polished is polished at a relatively high speed.

A semiconductor wafer 10, serving as a member to be polished, is mounted on a wafer chuck 15, serving as holding means, in a state in which a surface to be polished of the wafer 10 is upwardly placed. A polishing pad 21 is mounted on a lower surface of a polishing head 11. The diameter of the polishing pad 21 is larger than the diameter of the wafer 10 and is smaller than twice the diameter of the wafer 10. The polishing head 11 and the wafer chuck 15 are independently rotatable. The polishing pad 21 mounted on the polishing head 11 is also rotated in accordance with the rotation of the polishing head 11, and the wafer 10 mounted on the wafer chuck 15 is also rotated in accordance with the rotation of the wafer chuck 10. If the wafer 10 and the polishing pad 21 are rotated in the same direction at substantially the same rotation speed, uniform polishing is performed. It is also possible to provide swinging means for swinging at least one of the polishing head 11 and the wafer chuck 15 if necessary. By using such swinging means, uniform polishing can be performed even if the rotation speeds do not coincide.

The above-described configuration is common to both of the primary and secondary polishing stations.

When performing lower-speed finishing polishing by the secondary polishing station after performing high-speed rough polishing by the-primary polishing station, the rotation speed of the polishing pad or the wafer may be made to be lower than the rotation speed in the primary polishing station, or the polishing time period may be shortened, or the amount of supply of the polishing slurry used in the secondary polishing may be reduced, or the grain size of the abrasive grain in the slurry may be reduced, or the dispersion density of the abrasive grain in the slurry may be reduced. In the polished-state detection station, the state of the surface to be polished of the wafer 10 is detected using detection means 13, such as a thickness measuring apparatus or the like. When the detection means 13 detects that the wafer 10 is polished to a surface shape different from a desired surface shape, detected information is transmitted to the secondary polishing station. If the setting of the polishing conditions is changed by performing feedback of the information to the first polishing station, accuracy in subsequent wafer polishing is improved.

Finishing polishing is performed in the secondary polishing station. A polishing pad 23 having a diameter smaller than the diameter of the wafer 10 is mounted on a polishing head 14 used in the secondary polishing station, so that the surface to be polished of the wafer 10 is selectively polished locally. If necessary, the entire surface to be polished of the wafer 10 may be polished by swinging the polishing head 14. Since information relating to the polished state detected by the detection station is supplied to the secondary polishing station, a control device provided in the secondary polishing station processes that information to appropriately determine the rotation speeds of the polishing pad 23 and the wafer 10, and the position and the swinging range of the head 14.

A pad having a polishing surface smaller than the surface to be polished of the wafer is used as the polishing pad 23, and it is desirable that the surface of the polishing head 14 where the polishing pad 23 is mounted has substantially the same diameter as the diameter of the polishing pad 23. More specifically, when polishing a wafer having a diameter of 8 inches, a circular pad having a diameter of 10–30 mm is used. The polishing pad may be rectangular or fan-shaped instead of being circular.

It is desirable to provide partition means in the apparatus of the invention such that, for example, partition walls are provided between respective stations, or respective stations are disposed within four independent closable small chambers. The entire apparatus shown in FIG. 1 must be placed within a single chamber so as to be separated from the environment within a clean room.

In the present invention, a semiconductor wafer of Si, GaAs, InP or the like, or a semiconductor wafer of SOI (silicon on insulator) where a semiconductor layer is provided on the surface of an insulator may be used as the member to be polished. In particular, the polishing method of the present invention may be used in a process for forming interconnections on a wafer where semiconductor devices, such as transistors or the like, are formed.

A polishing liquid obtained by dispersing fine particles having relatively uniform diameters within a range between a few millimeters and submicrometers of silicon oxide, cerium oxide, zeolite oxide, chromium oxide, iron oxide, manganese oxide, silicon carbide, boron carbide, carbon, an ammonium salt or the like in a solution, such as an aqueous solution of sodium hydrochloride, an aqueous solution of potassium hydrochloride, an aqueous solution of ammonia, a solution of isocyanuric acid, Br—$CH_3OH$, an aqueous solution of hydrochloric acid, or the like may be preferably used as the abrasive used in the present invention.

The combination of fine particles and a solution can be selected in accordance with an object. For example, an abrasive obtained by dispersing fine particles of silicon oxide, cerium oxide, an ammonium salt, manganese dioxide or the like in one of the above-described solutions, an abrasive obtained by dispersing fine particles of silicon oxide in an aqueous solution of potassium hydroxide, and an abrasive obtained by dispersing fine particles of silicon oxide in an aqueous solution of ammonia containing hydrogen peroxide are suitable for polishing of the surface of Si, polishing of the surface of $SiO_2$, and polishing of a substrate having Al on its surface, respectively.

The abrasive may be supplied directly from a nozzle onto the surface to be polished, or via a hole provided in the polishing pad in a state in which the polishing pad presses the wafer. The latter method is desirable when performing uniform polishing. Most of the abrasive supplied on the wafer does not remain thereon due to a centrifugal force while the wafer is rotated at a high speed, so that only a small amount of abrasive tends to be nonuniformly distributed on the entire surface of the wafer. As a result, uniform polishing cannot be performed in that state. Accordingly, by supplying the abrasive on the surface to be polished via the polishing pads uniform polishing can be easily performed.

Embodiments of the present invention will now be described with reference to the drawings.

First Embodiment

Figure 2:
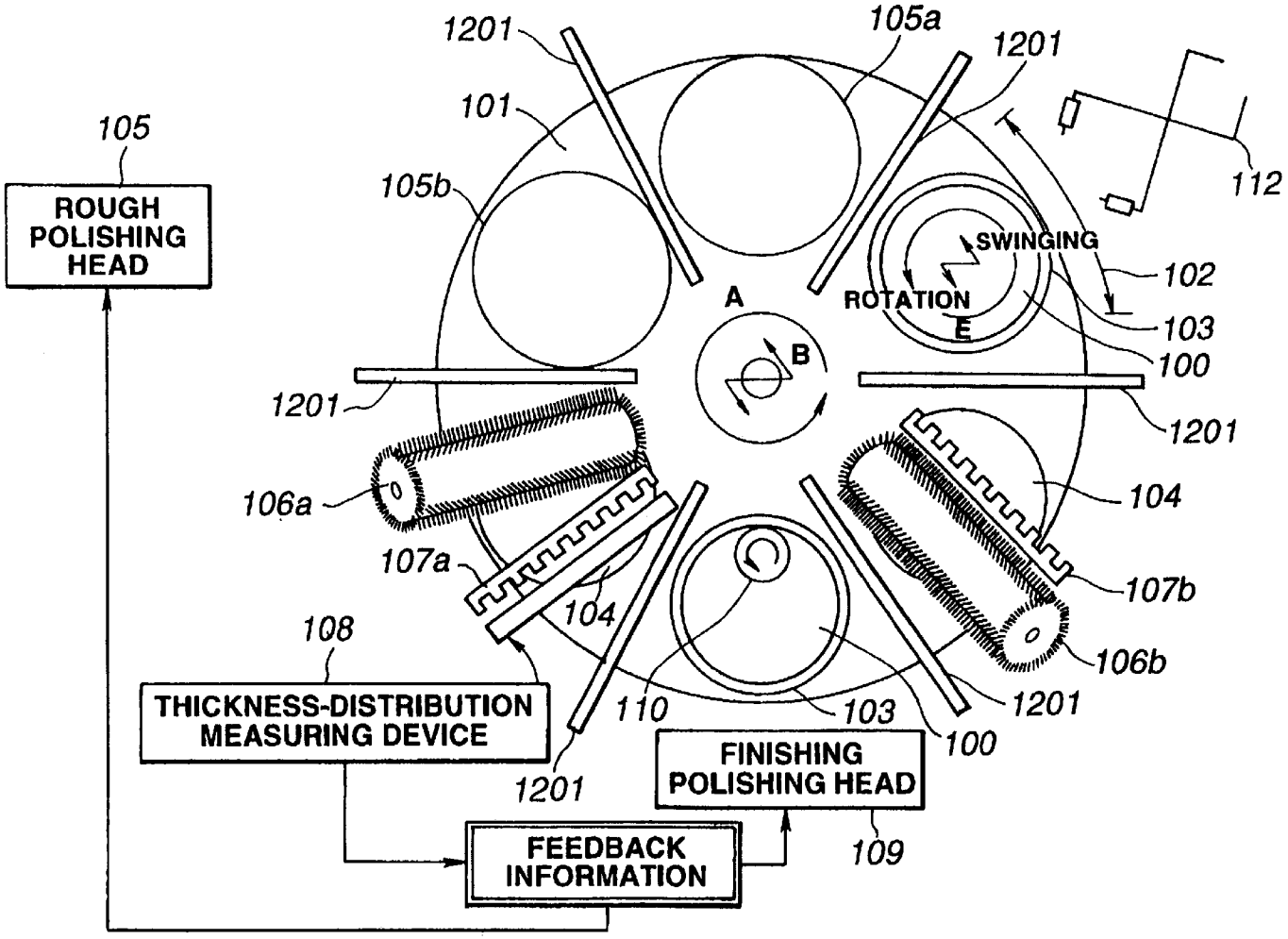
FIG. 2 is a schematic diagram illustrating a chemical mechanical polishing apparatus according to a first embodiment of the present invention.

FIG. 2 is a schematic diagram illustrating the configuration of a precision polishing apparatus according to a first embodiment of the present invention. In the first embodiment, three wafer chucks 103, serving as member-to-be-polished holding means, and three polishing-pad conditioners 104, serving as polishing-capability recovering means, are disposed on a cylindrical wafer table 101, serving as transfer means, and polishing, washing as cleaning and bringing-in/out processes are performed in six processing stations.

In the apparatus shown in FIG. 2, the wafer chucks 103 and the polishing-pad conditioners 104 are alternately disposed with an interval of 60° at the same distance from the center of the wafer table 101. A wafer bringing-in/out device 112 having arms for bringing in/out a wafer 100 is disposed at a wafer bringing-in/out position 102. The wafer table 101 is rotated around its center in a direction indicated by an arrow A by second driving means 202 (to be described later). A primary polishing head 105*a,* a secondary polishing head 105*b,* a scrubbing washer 106*a* as a cleaning unit, a washing device 107*a* as a cleaning unit, a thickness-distribution measuring device 108, a finishing polishing head 109, a scrubbing washer 106*a* and a washing device 107*a* are disposed above the wafer table 101 in the direction indicated by the arrow A from the wafer bringing-in/out position 102 so as to face the wafer chucks 103 and the polishing-pad conditioners 104 and to provide five processing stations as shown in FIG. 2. The scrubbing washer 106*a* and the washing device 107*a* are preferably used as cleaning units because they can clean the wafer effectively without causing scratches. At that time, the scrubbing washer 106*a,* the washing device 107*a* and the thickness-distribution measuring device 108 are disposed so as to provide a processing station immediately above the corresponding wafer chuck 103, and the scrubbing washer 106*b* and the washing device 107*b* are disposed so as to provide a processing station immediately above the corresponding polishing-pad conditioner 104. Reference numeral 1201 represents partition means for separating the respective processing stations. In the first embodiment, a diffusion of a slurry and contaminants as foreign matter is prevented using partition plates made of glass or resin.

Next, the configuration of the polishing station will be described.

Polishing pads having radii larger than the diameter of the wafer and smaller than twice the diameter of the wafer are provided in the primary polishing head 105*a* and the secondary polishing head 105*b.* A pad having a radius smaller than the diameter of the wafer is provided on the finishing polishing head 109. For example, the diameter of the polishing pad is made to be larger than the radius of the wafer by about tens of millimeters in order to polish the entire surface to be polished of the wafer 100 swinging within a range of tens of millimeters. The configuration of driving means for the wafer 100 will be described later.

The finishing polishing head 109 has a smaller diameter than the primary polishing head 105*a* and the secondary polishing head 105*b.* The primary polishing head 105*a* and the secondary polishing head 105*b* are hereinafter generically termed rough polishing heads 105 in contrast to the finishing polishing head 109.

Figure 3:
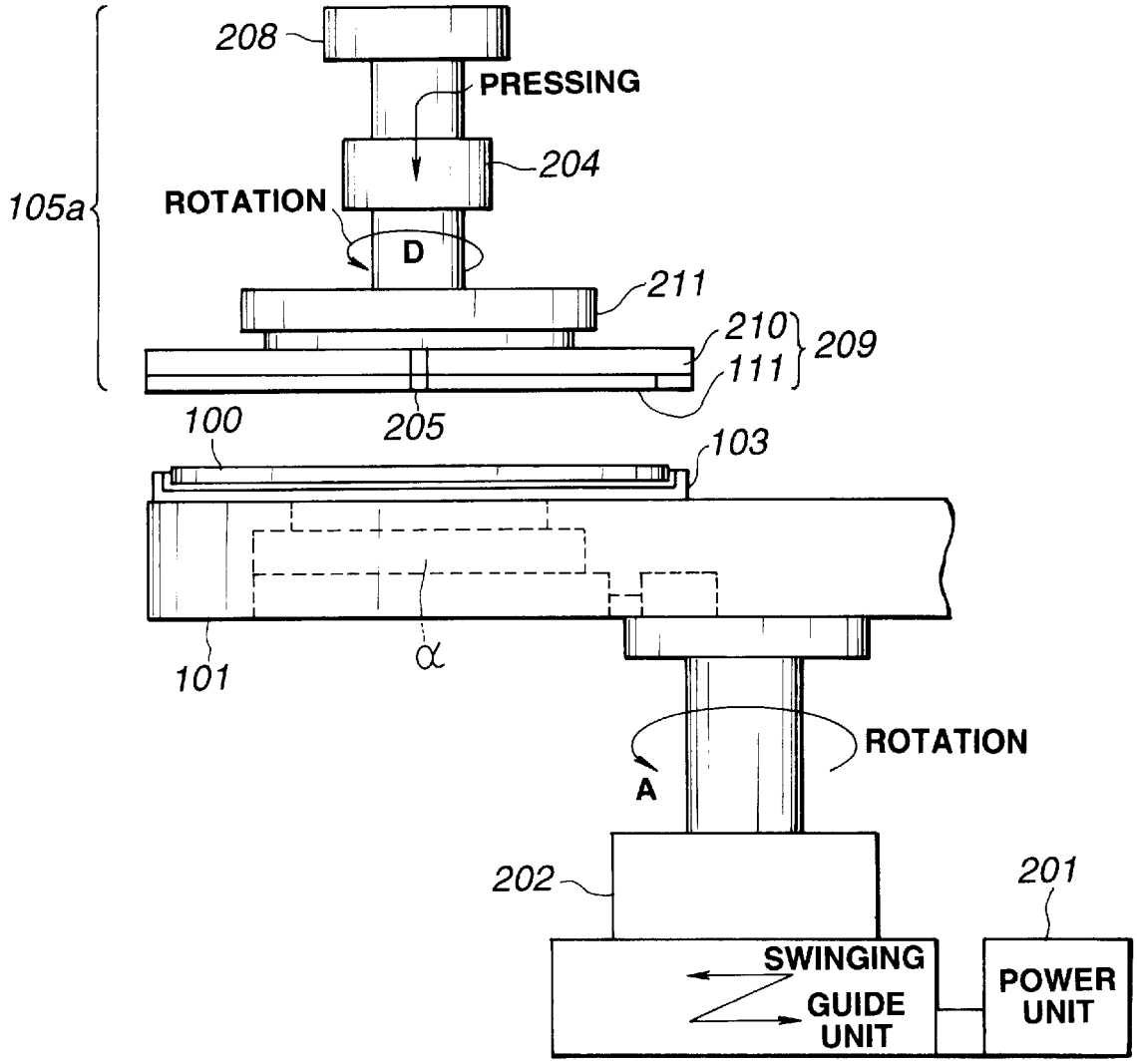
FIG. 3 is a schematic side view illustrating the entire polishing apparatus of the first embodiment.

FIG. 3 is a schematic cross-sectional view illustrating the primary (or secondary) polishing head 105*a* (105*b*) and the wafer table 101 of the polishing apparatus shown in FIG. 2. The wafer table 101 is rotated around its center in a direction indicated by an arrow A by the above-described second driving means. The wafer chuck 103 is rotated or swung by driving means provided within the wafer table 101. The configuration of the driving means will be described later with reference to FIG. 4.

The primary polishing head 105*a* includes a polishing unit 209, third driving means 204 and a pressing device 208. The polishing unit 209 includes a platen 210 where a polishing pad 111 is mounted, and a supporting member 211 for supporting the platen 210. The platen is also called a head. The supporting member 211 is vertically moved by the pressing device 208, and is rotated around its center in a direction indicated by an arrow D by the third driving means 204. Thus, each pad can be rotated. The polishing pad 111 has a small hole in its center, and an abrasive is supplied from this hole onto the wafer 100.

Figure 4:
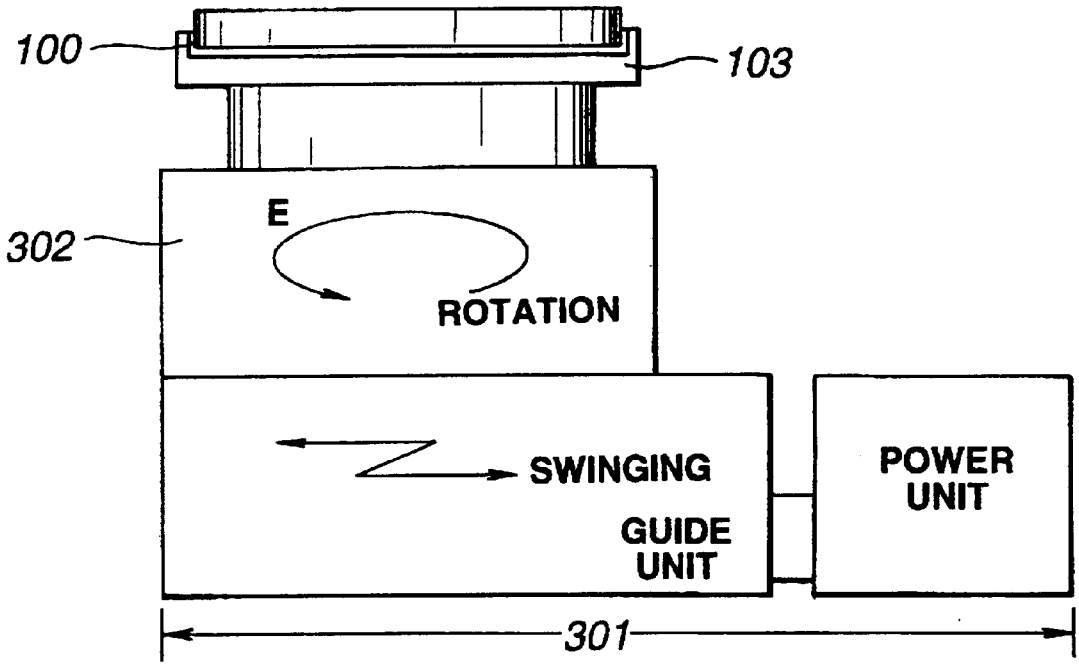
FIG. 4 is schematic diagram illustrating a wafer chuck and driving means therefor used in the present invention.

FIG. 4 is a schematic diagram illustrating the configuration of the driving device for the wafer chuck 103 which is disposed at a portion within the wafer table 101 shown in FIG. 3. As shown in FIG. 4, the wafer chuck 103 includes fourth driving means 301 and fifth driving means 302, and is swung along the surface of the wafer table 101 by the fourth driving means 301 and is rotated around the center of the wafer chuck 103 in a direction indicated by an arrow E by the fifth driving means 302. The swinging is effected within a range of tens of millimeters. The fourth driving means 301 includes a power unit and a guide unit.

Although the primary polishing head 105*a* has been described with reference to FIGS. 3 and 4, the secondary polishing head 105*b* can also polish the wafer 100 by performing rotation and swinging with the same configuration as that of the primary polishing head 105*a.* Instead of swinging the wafer with the configuration shown in FIG. 4, the primary polishing head 105*a,* the secondary polishing head 105*b* and the finishing polishing head 109 may be swung by providing driving means therefor. Alternatively, both of the wafer and these heads may be swung.

First driving means 201 shown in FIG. 3 is provided, if necessary. For example, the first driving means 201 is used when a further complicated movement is required during polishing. The first driving means 201 includes a guide unit and a power unit. The wafer table 101 is swung along the surface of the wafer table 101 in a direction indicated by a two-headed arrow B by the first driving means 201. In that case, the swinging is effected within a range of tens of millimeters.

The polishing property and drive of each polishing pad can be independently changed in accordance with polishing conditions. That is, the same polishing pads may be mounted on the primary polishing head 105*a* and the secondary polishing head 105*b,* and these heads may be set to the same polishing property. Alternatively, the primary polishing head 105*a* and the secondary polishing head 105*b* may have different polishing properties by mounting different polishing pads on the primary polishing head 105*a* and the secondary polishing head 105*b* or by changing the rotation speed between the primary polishing head 105*a* and the secondary polishing head 105*b.*

Although, in the first embodiment, the wafer chucks 103 and the polishing-pad conditioners 104 are alternately disposed at the same interval, different values may be adopted for some intervals, if necessary. The numbers of the wafer chucks 103 and the polishing-pad conditioners 104 are determined in accordance with the contents and the time periods of operation processes. Accordingly, if a necessary polished amount can be obtained, only the primary polishing head 105*a* may be used by omitting the secondary polishing head 105*b.* Alternatively, at least three polishing heads may be used.

Next, a description will be provided of a washing station, serving as foreign-matter removing means for removing foreign matter adhering to the wafer.

Each of the scrubbing washers 106*a* and 106*b* comprises, for example, a cylindrical soft brush. Each of the washing devices 107*a* and 107*b* includes a plurality of nozzles from which a washing liquid, such as pure water or the like, is discharged onto the wafer to remove the abrasive or foreign matter.

Next, a description will be provided of the thickness-distribution measuring device 108, serving as detection means for detecting the polished state.

The thickness-distribution measuring device 108 performs feedback of the result of measurement of a thickness distribution to the polishing head 109 and the rough polishing head 105. A method for processing the result of measurement of the thickness distribution will be described later. Set conditions for thickness measurement will now be described.

Driving conditions for each of the finishing polishing head 109 and the polishing head 105 comprise the type of the member to be polished, the type of the abrasive, the material and the polishing property of the polishing pad, the polishing pressure, and the rotation speeds of the polishing pad and the polishing head. Since the primary polishing head 105*a,* the secondary polishing head 105*b* and the finishing polishing head 109 can be independently driven, different driving conditions can be set for the respective heads. When setting the same driving conditions, it is also possible to select one of the primary polishing head 105*a* and the secondary polishing head 105*b* in accordance with the property of the wafer to be polished in order to adjust the polished amount by using the selected polishing head.

Although the total number of the wafer chucks 103 and the polishing-pad conditioners 104 disposed on the wafer table 101 shown in FIG. 2 is 6, any other total number may also be adopted. Furthermore, the numbers of the wafer chucks 103 and the polishing-pad conditioners 104 need not be equal. That is, the total number may be 4, 8, 10 or the like, or the numbers of the wafer chucks 103 and the polishing-pad conditioners 104 may, for example, be 2 and 4, respectively. In such cases, the rotation angle of the second driving means 202 may be appropriately changed so that the wafer chucks 103 and the polishing-pad conditioners 104 are placed immediately below the primary polishing head 105*a,* the secondary polishing head 105*b* and the finishing polishing head 109.

The wafer chucks 103 and the polishing-pad conditioners 104 are not necessarily disposed alternately. The wafer chucks 103 may be continuously disposed, or the polishing-pad conditioners 104 may be continuously disposed. In such cases, the rotational movement of the wafer table 101 may be appropriately changed.

Next, a description will be provided of a method for precisely polishing a semiconductor wafer when using the precision polishing apparatus of the first embodiment.

The wafer 100 brought in from the wafer bringing-in/out position 102 by the wafer bringing-in/out device 112 is fixed to the wafer chuck 103. The fixed wafer 100 is polished by the primary polishing head 105*a* after rotating the wafer table 101 in a direction indicated by an arrow A by 60°.

When the wafer 100 has been placed immediately below the primary polishing head 105*a,* the wafer 100 is polished by pressing the primary polishing head 105*a* against the wafer 100 by the pressing device 208 of the polishing head 105*a,* supplying the abrasive from the small hole 205 onto the wafer 100, rotating and swinging the wafer chuck 103, and rotating the polishing pad 111. Very precise polishing is performed by setting in advance the above-described initial driving conditions for the respective movements at that time. An example of detailed driving-conditions will now be shown.

The same speed and direction of rotation are provided for the wafer chuck 103, the polishing pad 111 and the primary polishing head 105 during polishing. The rotation speed is within a range equal to or less than 1,000 rpm, and preferably, 50–300 rpm.

The pressure of the primary polishing head 105*a* to be applied to the wafer 100 may be within a range of 0–1 $kg/cm^2$.

After being polished by the primary polishing head 105*a,* the wafer 100 is moved by the rotation of the wafer table 101 by 60°, and is also polished by the secondary polishing head 105*b*. The same polishing method as in the case of the primary polishing head 105*a* is adopted.

At that time, the polishing-pad conditioner 104 is placed immediately below the primary polishing head 105*a,* and another wafer is fixed to the wafer chuck 103 from the wafer bringing-in/out position 102. At that time, the primary polishing head 105*a* supplies pure water instead of the abrasive from the small hole 205 of the polishing pad 111, and slidably moves in cooperation with the polishing-pad conditioner 104 to remove residuals remaining on the surface of the polishing pad 111, i.e., the waste after polishing and the abrasive. The polishing pad 111 is thereby recovered to the polishing property before the polishing process.

By thus conditioning the polishing pad at every polishing operation, the problem of a decrease in the polishing property due to the continuous use of the polishing pad is solved. As described above, a decrease in the polishing property due to continuous use greatly influences variations in the quality of wafers.

Upon completion of polishing by the secondary polishing head 105*b,* the wafer 100 is further rotated by 60°, and is placed immediately below the washing station including the scrubbing washer 106*a,* the washing device 107*a* and the thickness-distribution measuring device 108. In this state, the abrasive and the waste of polishing on the surface of the wafer 100 are rubbed with the brush of the scrubbing washer 106*a* and are washed off by water to remove the residuals. Then, the thickness distribution is measured.

At that time, the polishing-pad conditioner 104 is placed immediately below the secondary polishing head 105*b*. The polishing property of the secondary polishing head 105*b* can be recovered by the same conditioning method as when recovering the polishing property of the primary polishing head 105*a*.

At the same time, the above-described other wafer is placed immediately below the primary polishing head 105*a,* and is polished by the same method as in the case of the wafer 100. At that time, the polishing-pad conditioner 104 is placed at the wafer bringing-in/out position 102.

Information relating to the measured thickness distribution is subjected to feedback to the finishing polishing head 109 for performing the final process. The information can also be subjected to feedback to the rough polishing head 105, and is utilized when setting polishing conditions for the succeeding wafer.

Upon completion of the thickness measurement, the wafer 100 is placed immediately below the finishing polishing head 109, and finishing polishing is performed. At the same time, residuals remaining on the polishing-pad conditioner 104 immediately succeeding the wafer 100 are removed by the scrubbing washer 106*a* and the washing device 107*a,* and the succeeding wafer is placed immediately below the secondary polishing head 105*b* and is polished. The polishing-pad conditioner 104 is placed immediately below the primary polishing head 105*a* to condition the polishing pad 111. A new wafer is fixed to the wafer chuck 103 at the wafer bringing-in/out position 102.

Residuals on the wafer 100 after completing finishing polishing are removed by the scrubbing washer 106*b* and the washing device 107*b,* and the polishing process is completed. Upon completion of the polishing process, the wafer 100 is conveyed to the wafer bringing-in/out position 102 and is then conveyed to the outside of the apparatus by the wafer bringing-in/out device 112.

Similarly, the wafer succeeding the wafer 100 passes through the polishing process as in the case of the wafer 100, and is conveyed to the outside of the apparatus from the wafer bringing-in/out position 102 by the wafer bringing-in/out device 112.

In the first embodiment, since the wafer chucks 103 and the polishing-pad conditioners 104 are alternately disposed, and the polishing pad is conditioned after polishing the wafer, a high polishing property of the polishing pad is always maintained. Furthermore, since the thickness-distribution measuring device 108 performs feedback of the result of measurement, and the polishing property of each of the polishing heads can be independently controlled based on that information, variations in the polished amount between the polished wafer and the succeeding wafer are reduced.

Next, a method for processing the result of the thickness measurement will be described.

The initial thickness or the thickness distribution, and the material of the wafer to be polished, the macroscopic distribution of the circuit pattern, a target value of the amount to be removed of the wafer, and the like are input in advance to a control device (not shown). After washing the wafer 100 polished by the secondary polishing head 105*b,* the thickness of the wafer 100 is measured by the thickness-distribution measuring device 108 and is compared with the target value of the amount to be removed, to obtain the removed amount or the distribution of the removed amount at finishing polishing.

The relationship between the removed amount per unit time (i.e., the polishing speed) and various kinds of parameters is stored in a memory of the control device in the form of a table or a calculation formula. Optimum polishing conditions for the amount to be removed and the distribution of the amount to be removed in finishing polishing are determined based on the information stored in the memory, and optimum driving conditions for the finishing polishing head 109 are selected and executed.

When the result of the thickness measurement indicates a great deviation from the amount to be removed by each of the primary polishing head 105*a* and the secondary polishing head 105*b,* which amounts are determined when starting the driving of the apparatus, a data base for driving the rough polishing head, which is similar to the above-described table or calculation formula, may be provided and subjected to feedback to at least one of the primary polishing head 105*a* and the secondary polishing head 105*b* by selecting optimum conditions from the data base, and rough polishing conditions may be newly set in order to efficiently perform polishing of the succeeding wafer. It is also desirable to store the amount to be removed for each wafer, and to determine conditioning conditions and the time of exchange for the polishing pad from the rate of change of the amount to be removed.

By thus sequentially transmitting and applying information, it is possible to control the time period of operation processes. The thickness-distribution measuring device of the present invention may be an apparatus which, for example, provides the ability to observe the polished surface as an image. The polished surface may be photographed as a still image by illuminating it from above using a white flashlight, or the rotating member to be polished may be photographed as moving images. It is thereby possible to observe the polished surface as a plane.

Second Embodiment

Figure 5:
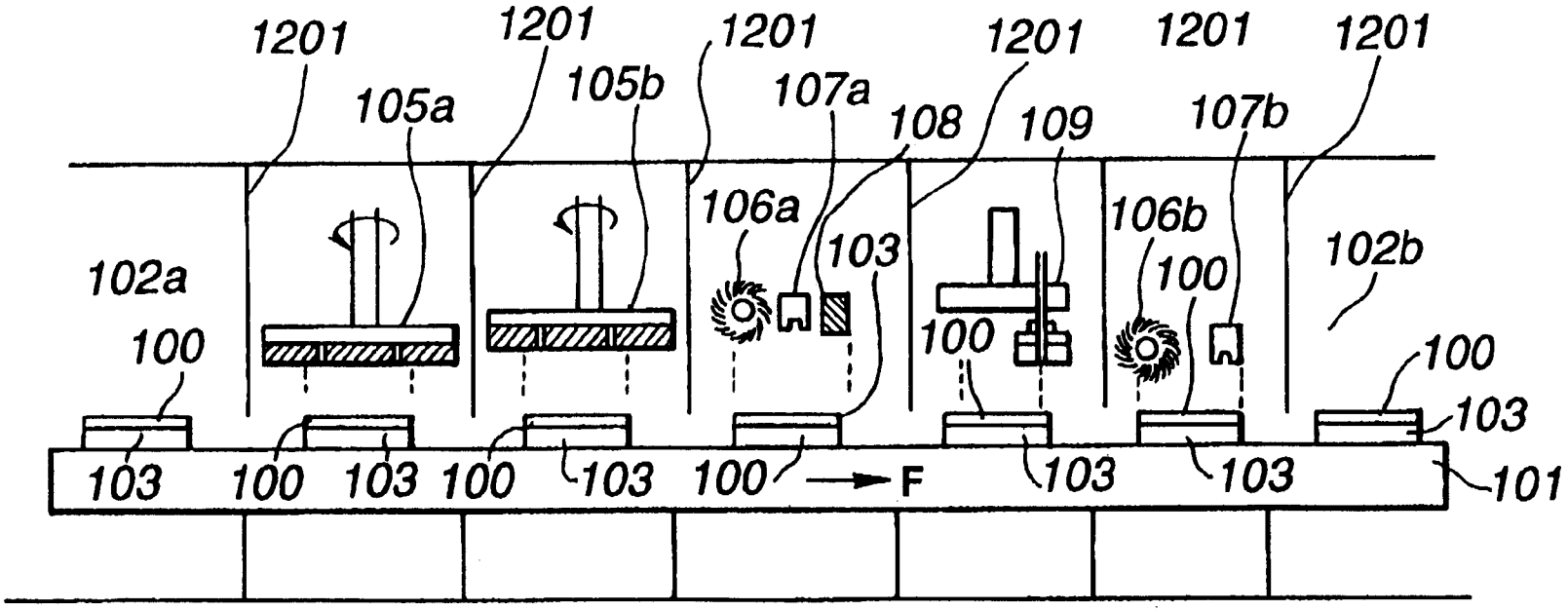
FIG. 5 is a schematic diagram illustrating a chemical mechanical polishing apparatus according to a second embodiment of the present invention.

FIG. 5 is a schematic diagram illustrating a precision polishing apparatus according to a second embodiment of the present invention. Although, in the second embodiment, an apparatus similar to that used in the first embodiment is used, polishing, washing and bringing-in/out processes are performed by moving a wafer through seven in-line processing stations.

In the first embodiment, the wafer chucks 103 and the polishing-pad conditioners 104 are moved in accordance with the rotation of the cylindrical wafer table 101. In the second embodiment, however, wafer chucks 103 on a wafer table 101 move in one direction. In accordance with the movement of the wafer table 101 in a direction of an arrow F, the wafer chucks 103 are sequentially moved in the direction of the arrow F, so that a wafer 100 is polished and washed in the respective processing stations.

In this apparatus, a wafer bringing-in position 101*a* and a wafer bringing-out position 102*b* are provided at different positions before and after the series of processing stations. The wafer chuck 103 includes driving means (not shown) for rotating and/or swinging the wafer 100. Reference numeral 1201 represents partition walls for separating the processing stations, and each of the processing stations is placed within an independent chamber.

Third Embodiment

Figure 6:
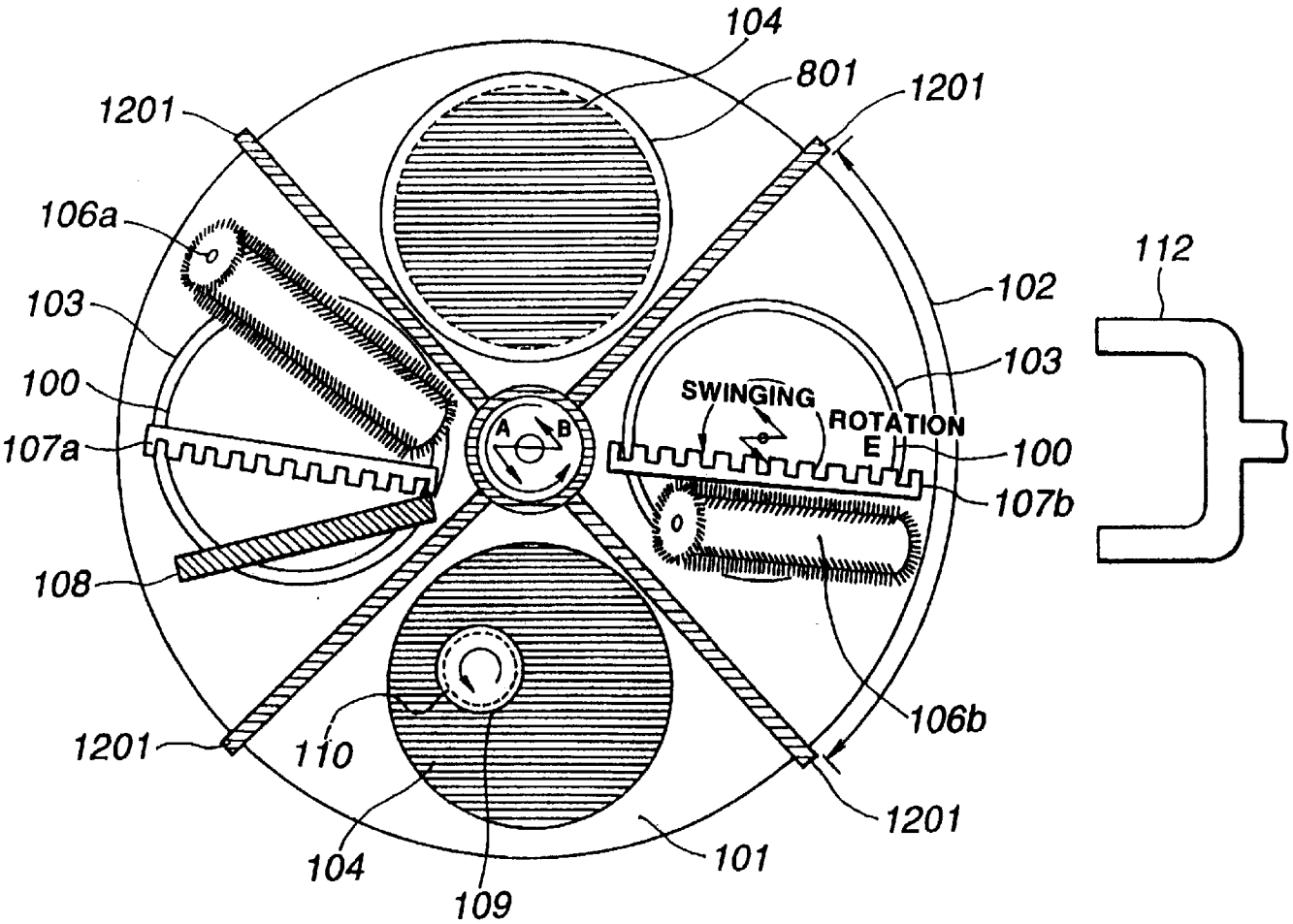
FIG. 6 is a schematic diagram illustrating a precision mechanical polishing apparatus according to a third embodiment of the present invention.
Figure 7:
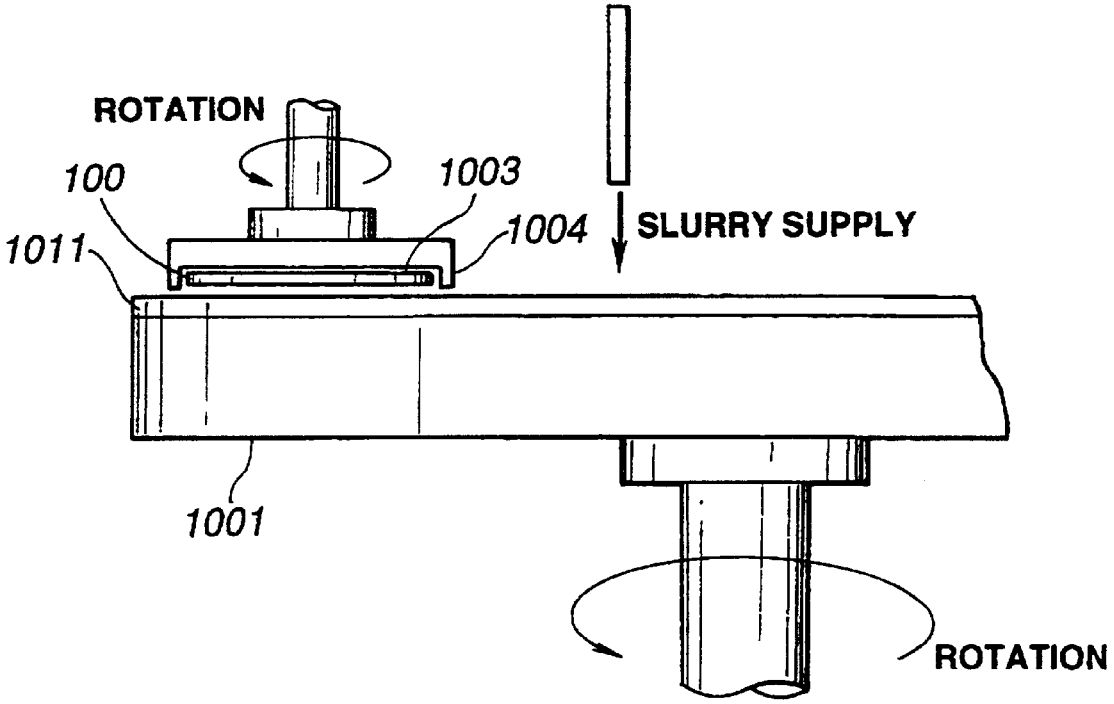
FIG. 7 is a schematic diagram illustrating a polishing operation unit of a conventional precision mechanical polishing apparatus in which a surface to be polished is downwardly placed.
Figure 8:
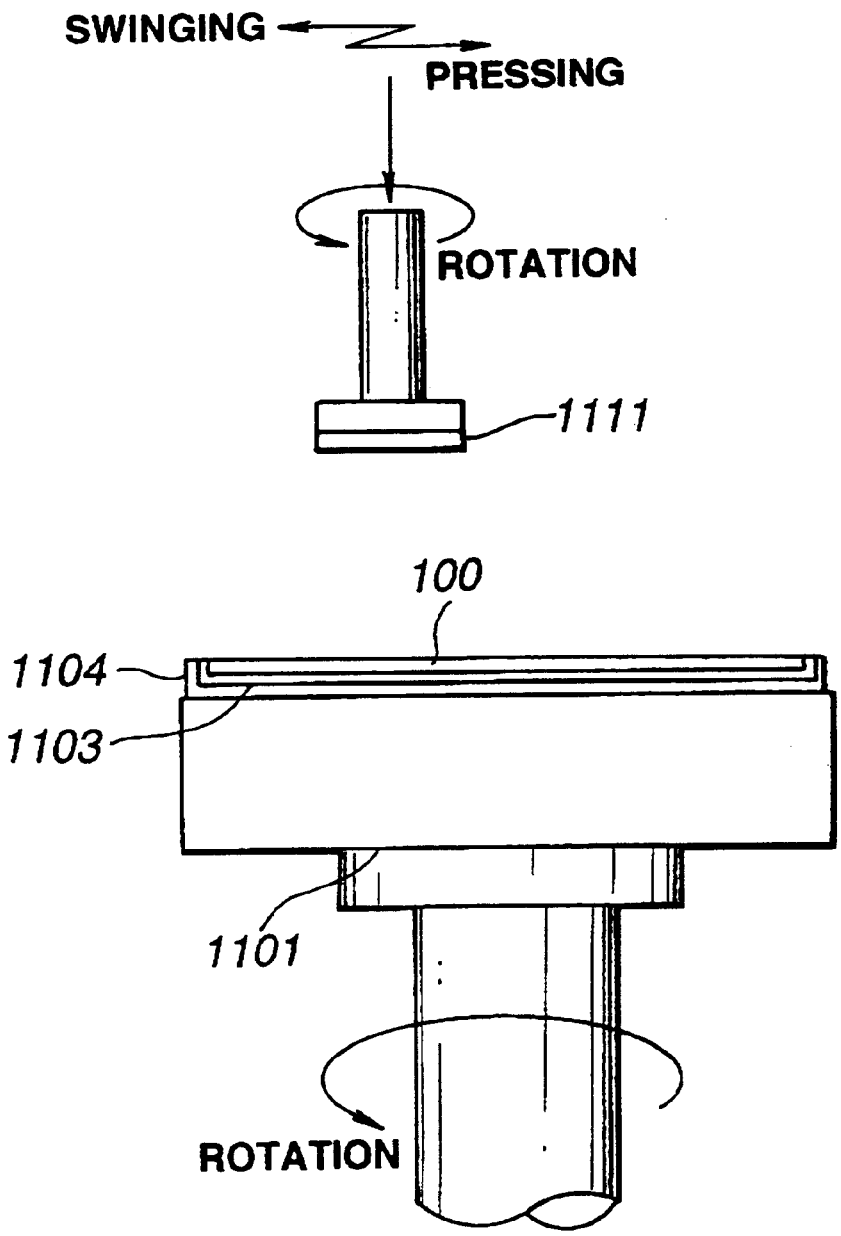
FIG. 8 is a schematic diagram illustrating a polishing operation unit of a conventional precision mechanical polishing apparatus in which a surface to be polished is upwardly placed.

FIG. 6 is a schematic diagram illustrating a polishing processing unit of a precision polishing apparatus according to a third embodiment of the present invention, as seen from above. In the third embodiment, two wafer chucks 103 and two detachably mountable polishing-pad conditioners 104 are disposed on the wafer table 101, and entire polishing, partial finishing polishing, washing and bringing-in/out processes are performed in four processing stations divided by partition plates 1201.

In the apparatus shown in FIG. 6, the wafer chucks 103 and the polishing-pad conditioners 104 are alternately disposed with an interval of 60° at the same distance from the center of the wafer table 101. A wafer bringing-in/out device 112 having arms for bringing in/out a wafer 100 is disposed at a wafer bringing-in/out position 102. A diamond abrasive grain is fixed on the polishing-pad conditioner 104.

As in the first embodiment, the wafer table 101 is rotated around its center in a direction indicated by an arrow A by second driving means 202 (not shown), to move the wafer. An entire-surface polishing head 801, a scrubbing washer 106*a,* a washing device 107*a,* a thickness-distribution measuring device 108, a finishing polishing head 109, a scrubbing washer 106*a* and a washing device 107*a* are disposed above the wafer table 101 in the direction indicated by the arrow A starting from the wafer bringing-in/out position 102 so as to face the wafer chucks 103 and the polishing-pad conditioners 104 and to provide four processing stations as shown in FIG. 6. As in the case shown in FIG. 4, the wafer chuck 103 includes sixth driving means 302 and fifth driving means 301, and performs rotation and swinging. The diameter of the entire-surface polishing head 801 is larger than the diameter of the wafer 100 by about 10 millimeters, because swinging is performed within a range of about 10 millimeters.

As in the first embodiment, the scrubbing washer 106*a,* the washing device 107*a* and the thickness-distribution measuring device 108 are disposed so as to provide a processing station immediately above the corresponding wafer chuck 103, and the scrubbing washer 106*b* and the washing device 107*b* are disposed so as to provide a processing station immediately above the corresponding wafer chuck 103.

The methods for driving the finishing polishing head 109, the wafer table 101, the wafer chucks 103 and the polishing-pad conditioners 104 are the same as in the first embodiment. The method for driving the entire-surface polishing head 801 is the same as the method for driving the primary polishing head 105*a* or the secondary polishing head 105*b* in the first embodiment.

Devices which are desirably added depending on the operation process will now be described.

Although the entire-surface polishing head 801 and the finishing polishing head 109 are rotatable, these heads may be swung by providing, if necessary, driving means at the head side instead of swinging the wafer, or both of the heads and the wafer may be swung.

The wafer table 101 may be swung along the surface of the wafer table 101 in a direction indicated by an arrow B by driving means (not shown).

Although, in the third embodiment, the wafer chucks 103 and the polishing-pad conditioners 104 are alternately disposed at the same interval, different values may be adopted for some intervals, if necessary. The total number of the wafer chucks 103 and the polishing-pad conditioners 104 may be 1, 2, 3 or at least 5. The numbers of the wafer chucks 103 and the polishing-pad conditioners are not necessarily the same.

A number of the entire-surface polishing head 801 may be provided.

The polishing conditions, the polishing method, and the thickness-distribution measuring device are the same as in the first embodiment. That is, the wafer 100 brought from the wafer bringing-in/out position 102 to the wafer chuck 103 by the wafer bringing-in/out device 112 is conveyed in a direction indicated by an arrow A by the wafer table 101, is then subjected to entire polishing, washing, finishing partial polishing and washing, and is brought out from the wafer bringing-in/out position 102 by the wafer bringing-in/out device 112.

In the third embodiment, also, since the wafer chucks 103 and the polishing-pad conditioner 104 are alternately disposed, and the polishing pad is conditioned after polishing the wafer, a high polishing property of the polishing pad is always maintained. Furthermore, since the thickness-distribution measuring device 108 performs feedback of the result of measurement, and the polishing property of each of the polishing heads can be independently controlled based on that information, variations in the polished amount between the polished wafer and the succeeding wafer are reduced.

By providing a plurality of wafer chucks and a plurality of polishing-pad conditioners on the same surface, and sequentially transferring the wafer chucks and the polishing-pad conditioners to the processing station where a polishing head is provided by transfer means, the processing time period can be reduced. For example, in the first embodiment, if the time period for rotating the wafer table 101 by 60° (index time) is assumed to be 1 minute, each wafer starting from the fifth wafer brought in from the wafer bringing-in/out position 102 and polished by passing through respective processes can be brought out from the wafer bringing-in/out position 102 at every 1 minute (tact time). Accordingly, when continuously processing a large amount of wafers in a semiconductor manufacturing process, the present invention is very advantageous. Since foreign matter adhering to the polishing pad is removed every time polishing has been completed and therefore, the state of the polishing pad can be maintained constant, it is possible to obtain wafers with a high production yield.

As described above, by using the precision polishing apparatus of the present invention, it is possible to polish not only conventional 8-inch wafers, but also 12-inch wafers very precisely and with a high throughput. This is because, by dividing the polishing process into entire polishing and correction polishing where only a part of the wafer is polished, it is possible to perform polishing by partially correcting concave and convex portions of the wafer itself and concave and convex portions produced when providing multilayer interconnections in the production process due to the use of a large-diameter wafer both in rough polishing and finishing polishing.

Concave and convex portions produced in patterning in a device forming process have intervals within a range of submicrometers and millimeters, and have a height of about 1 micrometer. Concave and convex portions are present in a direction perpendicular to the surface to be polished of a bare wafer. Such concave and convex portions are produced by warping of the bare wafer itself or variations in the thickness of the wafer. For example, in some cases, a warp of about 75 $\mu$m is generated, or variations in the thickness of the wafer of about 25 $\mu$m are present.

In addition, concave and convex portions within a range of about 10 millimeters are produced in a direction parallel to the surface of the wafer due to warping of the wafer.

Accordingly, macroscopic concave and convex portions of about 10 millimeters and microscopic concave and convex portions of at least submicrometers are simultaneously present, and concave and convex portions in a direction perpendicular to the surface to be polished of the wafer, such as warping of the wafer itself, or variations in the thickness, are also present.

In such a case, by combining a process of polishing the entire surface of the wafer using a polishing pad having a diameter slightly larger than the diameter of the wafer and correction polishing of partially polishing the wafer using a polishing pad having a diameter smaller than the diameter of the wafer, it is possible to perform polishing so as to coincide with the target shape of the surface.

Furthermore, by arbitrarily combining the rotation and swinging of the wafer chuck, the swinging of the wafer table, the rotation and swinging of the polishing pad, and the like, it is possible to assure target polishing conditions and to perform high-quality polishing.

In addition, by performing feedback of the result of measurement of the thickness of the wafer to the finishing polishing process to adjust set conditions for correction polishing, exact finishing polishing can be performed. At the same time, by performing feedback of the result of measurement of the thickness of the wafer to the polishing process, it is possible to utilize the result for setting conditions when performing rough polishing of the succeeding wafer, and therefore, to perform more effective polishing.

The individual components shown in outline in the drawings are all well-known in the polishing apparatus and method arts and their specific construction and operation are not critical to the operation or the best mode for carrying out the invention.

While the present invention has been described with respect to what are presently considered to be the preferred embodiments, it is to be understood that the invention is not limited to the disclosed embodiments. To the contrary, the present invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A polishing apparatus comprising:

a first polishing station comprising first holding means for holding a member to be polished in a state in which a surface to be polished thereof is upwardly placed, and a first polishing head for holding and rotating a polishing pad whose polishing surface is larger than the surface to be polished in a state of contacting the surface to be polished;

a detection station for detecting a polished state of the surface to be polished in a state in which the surface to be polished is upwardly placed and for producing a detection result; and a second polishing station comprising second holding means for holding the member to be polished in a state in which the surface to be polished thereof is upwardly placed, and a second polishing head for holding and rotating a polishing pad whose polishing surface is smaller than the surface to be polished in a state of contacting the surface to be polished, said second polishing station operating in accordance with the detection result, regarding the polished state of the surface to be polished, wherein said first polishing station, said detection station and said second polishing station are provided within corresponding chambers separated by partition means and separated from atmospheric air.

2. A polishing apparatus according to claim 1, wherein said first polishing station, said detection station and said second polishing station are separated by partition means.

3. A polishing apparatus according to claim 1, wherein said first polishing station is divided into a primary polishing station for performing polishing at a predetermined polishing speed, and a secondary polishing station for performing polishing at a speed lower than the polishing speed of said primary polishing station.

4. A polishing apparatus according to claim 1, further comprising member-to-be-polished conveying means for conveying the member to be polished between said first polishing station, said detection station and said second polishing station in a state in which the surface to be polished is upwardly placed.

5. A polishing apparatus according to claim 1, wherein each of said first and second polishing heads comprises driving means for swinging the polishing head along the surface to be polished of the member to be polished.

6. A polishing apparatus according to claim 1, wherein the diameter of the polishing pad mounted on said first polishing head is smaller than twice the diameter of the surface to be polished.

7. A polishing apparatus according to claim 1, wherein said first polishing station comprises a rough polishing head where a rough polishing pad for performing rough polishing of the surface to be polished of the member to be polished is mounted, and a finishing polishing head where a finishing polishing pad for performing finishing polishing of the surface to be polished of the member to be polished is mounted.

8. A polishing apparatus according to claim 1, wherein each of said first and second polishing heads includes a small hole for supplying an abrasive or a cleaning liquid.

9. A polishing apparatus according to claim 1, wherein said detection station for detecting the polished state of the surface detects surface shape characteristics.

10. A polishing apparatus according to claim 1, further comprising foreign-matter removing means for removing foreign matter adhering to the member to be polished.

11. A polishing apparatus according to claim 10, wherein said foreign-matter removing means comprises a scrubbing cleaning unit, and a cleaning supply nozzle for supplying a cleaning liquid.

12. A polishing apparatus according to claim 11, wherein said scrubbing cleaning unit comprises a cylindrical brush.

13. A polishing apparatus according to claim 1, wherein the member to be polished is a semiconductor wafer.

14. A polishing apparatus according to claim 1, wherein each of said first and second holding means is rotated around the center of the surface to be polished of the member to be polished by driving means.

15. A polishing apparatus according to claim 1, wherein each of said first and second holding means is swung along the surface to be polished of the member to be polished by driving means.

16. A polishing apparatus according to claim 1, wherein each of said first and second polishing heads comprises pressing means, and driving means for rotating the polishing pad around its axis.

17. A polishing apparatus operating according to first polishing station operating parameters and second polishing station operating parameters, said apparatus comprising:

a first polishing station for performing polishing according to the first polishing station operating parameters, said first polishing station comprising first holding means for holding a member to be polished, and a first polishing head for holding and rotating a polishing pad whose polishing surface is larger than a surface to be polished in a state of contacting the surface to be polished;

a detection station for detecting surface shape characteristics of a polished state of the surface to be polished and for producing a detection result corresponding to the detection of the surface shape characteristics;

a second polishing station for performing polishing according to the second polishing station operating parameters, said second polishing station comprising second holding means for holding the member to be polished, and a second polishing head for holding and rotating a polishing pad whose polishing surface is smaller than the surface to be polished in a state of contacting the surface to be polished; and a controller for automatically adjusting the second polishing station operating parameters according to the detection result.

18. A polishing method using first polishing station operating parameters and second polishing station operating parameters, said method comprising:

a first polishing step of mounting a member to be polished on first holding means, and polishing a surface to be polished according to the first polishing station operating parameters by rotating a polishing pad whose polishing surface is larger than the surface to be polished in a state of contacting the surface to be polished;

a detection step of detecting surface shape characteristics of a polished state of the surface to be polished, and producing a detection result corresponding to the detection of the surface shape characteristics;

a second polishing step of mounting the member to be polished on second holding means, and polishing the surface to be polished according to the second polishing station operating parameters by rotating a polishing pad whose polishing surface is smaller than the surface to be polished in a state of contacting the surface to be polished; and a controlling step for automatically adjusting the second polishing station operating parameters according to the detection result in said detection step.

19. A polishing method comprising:

a first polishing step of mounting a member to be polished on first holding means in a state in which a surface to be polished of the member is upwardly placed, and polishing the surface to be polished by rotating a polishing pad whose polishing surface is larger than the surface to be polished in a state of contacting the surface to be polished;

a detection step of detecting a polished state of the surface to be polished in a state in which the surface to be polished is upwardly placed, and producing a detection result based on the detected polished state;

a second polishing step of mounting the member to be polished on second holding means in a state in which the surface to be polished of the member is upwardly placed, and polishing the surface to be polished by rotating a polishing pad whose polishing surface is smaller than the surface to be polished in a state of contacting the surface to be polished, said second polishing step operating in accordance with the detection result, regarding the polished state of the surface to be polished; and providing said first polishing step, said detection step, and said second polishing step within corresponding chambers separated by partition means and separated from atmospheric air.

20. A polishing method according to claim 19, wherein said first polishing step, said detection step and said second polishing step are separated by partition means.

21. A polishing method according to claim 19, wherein said first polishing step is divided into a primary polishing step of performing polishing at a predetermined polishing speed, and a secondary polishing step of performing polishing at a speed lower than the polishing speed of said primary polishing step.

22. A polishing method according to claim 19, further comprising a conveying step of conveying the member to be polished between said first polishing step, said detection step and said second polishing step in a state in which the surface to be polished is upwardly placed.

23. A polishing method according to claim 19, wherein the member to be polished is a semiconductor wafer.

24. A polishing method according to claim 19, wherein the member to be polished is a wafer having semiconductor devices formed thereon.

25. A polishing method according to claim 19, further comprising the step of detecting a polished state of the member to be polished after completing the first and second polishing steps, wherein a result of the detection is subjected to feedback to at least one of said first polishing step and said second polishing step.

26. A polishing method according to claim 19, wherein, in said first polishing step, polishing is performed using a polishing pad whose diameter is smaller than twice the diameter of the surface to be polished.

27. A polishing method according to claim 19, wherein said detection step of detecting the polished state of the surface includes detecting surface shape characteristics.

28. A polishing apparatus comprising:

a first polishing station comprising first holding means for holding a member to be polished, and a first polishing head for holding and rotating a polishing pad whose polishing surface is larger than a surface to be polished in a state of contacting the surface to be polished;

a detection station for detecting a polished state of the surface to be polished and for producing a detection result; and a second polishing station comprising second holding means for holding the member to be polished, and a second polishing head for holding and rotating a polishing pad whose polishing surface is smaller than the surface to be polished in a state of contacting the surface to be polished, said second polishing station operating in accordance with the detection result, regarding the polished state of the surface to be polished, wherein said first polishing station, said detection station, and said second polishing station are provided within corresponding chambers separated by partition means and separated from atmospheric air.

29. A polishing method comprising:

a first polishing step of mounting a member to be polished on first holding means, and polishing a surface to be polished by rotating a polishing pad whose polishing surface is larger than the surface to be polished in a state of contacting the surface to be polished;

a detection step of detecting a polished state of the surface to be polished;

a producing step for producing a detection result based on the polished state detected during said detection step;

a second polishing step of mounting the member to be polished on second holding means, and polishing the surface to be polished by rotating a polishing pad whose polishing surface is smaller than the surface to be polished in a state of contacting the surface to be polished, said second polishing step operating in accordance with the detection result, regarding the polished state of the surface to be polished; and providing said first polishing step, said detection step, and said second polishing step within corresponding chambers separated by partition means and separated from atmospheric air.

30. A polishing apparatus comprising:

a first polishing station comprising first holding means for holding a member to be polished, and a first polishing head for holding and rotating a polishing pad whose polishing surface is larger than a surface to be polished in a state of contacting the surface to be polished;

a detection station for detecting a polished state of the surface to be polished and for producing a detection result; and a second polishing station comprising second holding means for holding the member to be polished, and a second polishing head for holding and rotating a polishing pad whose polishing surface is smaller than the surface to be polished in a state of contacting the surface to be polished, said second polishing station operating in accordance with the detection result, regarding the polished state of the surface to be polished, wherein said first polishing station, said detection station and said second polishing station are provided within corresponding chambers separated by partition means and separated from atmospheric air.

31. A polishing method comprising:

a first polishing step of mounting a member to be polished on first holding means, and polishing a surface to be polished by rotating a polishing pad whose polishing surface is larger than the surface to be polished in a state of contacting the surface to be polished;

a detection step of detecting a polished state of the surface to be polished, and producing a detection result based on the detected polished state;

a second polishing step of mounting the member to be polished on second holding means, and polishing the surface to be polished by rotating a polishing pad whose polishing surface is smaller than the surface to be polished in a state of contacting the surface to be polished, said second polishing step operating in accordance with the detection result, regarding the polished state of the surface to be polished; and providing said first polishing step, said detection step, and said second polishing step within corresponding chambers separated by partition means and separated from atmospheric air.

32. A polishing apparatus operating according to first polishing station operating parameters and second polishing station operating parameters, said apparatus comprising:

a first polishing station for performing polishing according to the first polishing station operating parameters, said first polishing station comprising first holding means for holding a member to be polished in a state in which a surface to be polished thereof is upwardly placed, and a first polishing head for holding and rotating a polishing pad whose polishing surface is larger than the surface to be polished in a state of contacting the surface to be polished;

a detection station for detecting surface shape characteristics of a polished state of the surface to be polished in a state in which the surface to be polished is upwardly placed and for producing a detection result corresponding to the detection of the surface shape characteristics;

a second polishing station for performing polishing according to the second polishing station operating parameters, said second polishing station comprising second holding means for holding the member to be polished in a state in which the surface to be polished thereof is upwardly placed, and a second polishing head for holding and rotating a polishing pad whose polishing surface is smaller than the surface to be polished in a state of contacting the surface to be polished; and a controller for automatically adjusting the second polishing station operating parameters according to the detection result.

33. A polishing apparatus according to claim 32, wherein said first polishing station, said detection station and said second polishing station are separated by partition means.

34. A polishing apparatus according to claim 32, wherein said first polishing station is divided into a primary polishing station for performing polishing at a predetermined polishing speed, and a secondary polishing station for performing polishing at a speed lower than the polishing speed of said primary polishing station.

35. A polishing apparatus according to claim 32, further comprising member-to-be-polished conveying means for conveying the member to be polished between said first polishing station, said detection station and said second polishing station in a state in which the surface to be polished is upwardly placed.

36. A polishing apparatus according to claim 32, wherein said first polishing station, said detection station and said second polishing station are provided within corresponding chambers separated by partition means and separated from atmospheric air.

37. A polishing apparatus according to claim 32, wherein the diameter of the polishing pad mounted on said first polishing head is smaller than twice the diameter of the surface to be polished.

38. A polishing apparatus according to claim 32, wherein the member to be polished is a semiconductor wafer.

39. A polishing apparatus according to claim 32, wherein each of said first and second holding means is rotated around the center of the surface to be polished of the member to be polished by driving means.

40. A polishing apparatus according to claim 32, wherein each of said first and second holding means is swung along the surface to be polished of the member to be polished by driving means.

41. A polishing apparatus according to claim 32, wherein each of said first and second polishing heads comprises pressing means, and driving means for rotating the polishing pad around its axis.

42. A polishing apparatus according to claim 32, wherein each of said first and second polishing heads comprises driving means for swinging the polishing head along the surface to be polished of the member to be polished.

43. A polishing apparatus according to claim 32, wherein said first polishing station comprises a rough polishing head where a rough polishing pad for performing rough polishing of the surface to be polished of the member to be polished is mounted, and a finishing polishing head where a finishing polishing pad for performing finishing polishing of the surface to be polished of the member to be polished is mounted.

44. A polishing apparatus according to claim 32, wherein each of said first and second polishing heads includes a small hole for supplying an abrasive or a cleaning liquid.

45. A polishing apparatus according to claim 32, wherein said controller further automatically adjusts the first polishing station operating parameters based on the detection result.

46. A polishing apparatus according to claim 32, further comprising foreign-matter removing means for removing foreign matter adhering to the member to be polished.

47. A polishing apparatus according to claim 46, wherein said foreign-matter removing means comprises a scrubbing cleaning unit, and a cleaning supply nozzle for supplying a cleaning liquid.

48. A polishing apparatus according to claim 47, wherein said scrubbing cleaning unit comprises a cylindrical brush.

49. A polishing method using first polishing station operating parameters and second polishing station operating parameters, said method comprising:

a first polishing step of mounting a member to be polished on first holding means in a state in which a surface to be polished of the member is upwardly placed, and polishing the surface to be polished according to the first polishing station operating parameters by rotating a polishing pad whose polishing surface is larger than the surface to be polished in a state of contacting the surface to be polished;

a detection step of detecting surface shape characteristics of a polished state of the surface to be polished in a state in which the surface to be polished is upwardly placed, and producing a detection result corresponding to the detection of the surface shape characteristics;

a second polishing step of mounting the member to be polished on second holding means in a state in which the surface to be polished of the member is upwardly placed, and polishing the surface to be polished according to the second polishing station operating parameters by rotating a polishing pad whose polishing surface is smaller than the surface to be polished in a state of contacting the surface to be polished; and a controlling step for automatically adjusting the second polishing station operating parameters according to the detection result in said detection step.

50. A polishing method according to claim 49, wherein said first polishing step, said detection step and said second polishing step are separated by partition means.

51. A polishing method according to claim 49, wherein said first polishing step is divided into a primary polishing step of performing polishing at a predetermined polishing speed, and a secondary polishing step of performing polishing at a speed lower than the polishing speed of said primary polishing step.

52. A polishing method according to claim 49, further comprising a conveying step of conveying the member to be polished between said first polishing step, said detection step and said second polishing step in a state in which the surface to be polished is upwardly placed.

53. A polishing method according to claim 49, wherein said first polishing step, said detection step and said second polishing step are provided within corresponding chambers separated by partition means and separated from atmospheric air.

54. A polishing method according to claim 49, wherein, in said first polishing step, polishing is performed using a polishing pad whose diameter is smaller than twice the diameter of the surface to be polished.

55. A polishing method according to claim 49, wherein the member to be polished is a semiconductor wafer.

56. A polishing method according to claim 49, wherein the member to be polished is a wafer having semiconductor devices formed thereon.

57. A polishing method according to claim 49, further comprising the step of detecting a polished state of the member to be polished after completing the first and second polishing steps, wherein a result of the detection is subjected to feedback to at least one of said first polishing step and said second polishing step.

58. A polishing method according to claim 49, wherein said controlling step further automatically adjusts the first polishing station operating parameters based on the detection result in said detection step.

* * * * *

UNITED STATES PATENT AND TRADEMARK OFFICE

CERTIFICATE OF CORRECTION

PATENT NO. : 6,183,345 B1
DATED : February 6, 2001
INVENTOR(S) : Takashi Kamono et al.

It is certified that error appears in the above-identified patent and that said Letters Patent is hereby corrected as shown below:

Column 2,
Line 37, "the" (first occurrence) should read -- than --.

Column 4,
Line 28, "chemical" should read -- chemical- --.
Line 31, "chemical" should read -- chemical- --.
Line 39, "chemical" should read -- chemical- --.

Column 5,
Line 22, "the-primary" should read -- the primary --.

Column 7,
Line 67, "portion within" should read -- portion ∝ within --.

Signed and Sealed this

Eleventh Day of December, 2001

*Attest:*

Nicholas P. Godici

NICHOLAS P. GODICI
*Acting Director of the United States Patent and Trademark Office*

*Attesting Officer*